US006257099B1

(12) United States Patent
Rosenbaum

(10) Patent No.: US 6,257,099 B1
(45) Date of Patent: Jul. 10, 2001

(54) MULTI-FUNCTION FAUCET WRENCHES

(76) Inventor: Kevin W. Rosenbaum, 23 Oak Rd., Rocky River, OH (US) 44116

( * ) Notice: Subject to any disclaimer, the term of this patent is extended or adjusted under 35 U.S.C. 154(b) by 0 days.

(21) Appl. No.: 09/382,162

(22) Filed: Aug. 24, 1999

(51) Int. Cl.[7] ..... B25B 13/02
(52) U.S. Cl. ..... 81/124.4; 81/176.15
(58) Field of Search ..... 81/124.4, 124.3, 81/121.1, 125.1, 124.7, 177.5, 176.15, 461

(56) References Cited

U.S. PATENT DOCUMENTS

| | | | | |
|---|---|---|---|---|
| 174,486 | * | 3/1876 | Collingsworth | 81/125.1 |
| D. 366,403 | | 1/1996 | Yearwood . | |
| D. 402,517 | | 12/1998 | Gracia et al. . | |
| 1,659,015 | * | 2/1928 | Breed | 81/125.1 |
| 2,445,905 | * | 7/1948 | Busby | 81/124.3 |
| 3,678,789 | * | 7/1972 | Wilson | 81/64 |
| 3,742,789 | * | 7/1973 | Rusk et al. | 81/176.15 |
| 3,837,244 | | 9/1974 | Schera, Jr. . | |
| 4,727,782 | * | 3/1988 | Yang | 81/124.4 |
| 4,924,544 | | 5/1990 | Culotta . | |
| 5,048,378 | * | 9/1991 | Nikolas | 81/124.2 |
| 5,272,942 | * | 12/1993 | Hull et al. | 81/124.4 |
| 5,367,925 | * | 11/1994 | Gasparre | 81/121.1 |
| 5,542,321 | * | 8/1996 | Fuca | 81/125.1 |
| 5,996,447 | * | 12/1999 | Bayouth | 81/176.2 |

OTHER PUBLICATIONS

MOEN® Single Handle Kitchen Faucet Publication, © 1996.
MOEN® Two Handle Lavatory Faucet Publication, © 1995.

* cited by examiner

*Primary Examiner*—James G. Smith
*Assistant Examiner*—David B Thomas
(74) *Attorney, Agent, or Firm*—Renner, Otto, Boisselle & Sklar, LLP

(57) ABSTRACT

Multi-function faucet wrenches include an elongated body member having a nut receiving socket at one end and a pair of laterally spaced spanner-like projections at the same end as the socket or at the other end. Where the spanner-like projections are at the same end as the nut receiving socket, an aerator receiving recess may be provided in the other end. Alternatively, one or more aerator receiving recesses may be provided in the outer surface of the member intermediate the ends thereof.

19 Claims, 5 Drawing Sheets

MULTI-FUNCTION FAUCET WRENCHES

FIELD OF THE INVENTION

This invention relates generally to multi-function faucet wrenches for installing faucets and/or making faucet repairs.

BACKGROUND OF THE INVENTION

Faucets often require special plumbing tools to install and to disassemble to make repairs to parts that sometimes wear out or require cleaning. Some faucet manufacturers provide special tools or wrenches to assist in the installation and/or repair of their own faucets. However, these tools typically are designed to perform a single function, thus either necessitating the manufacturer to provide the installer or homeowner with more than one tool, or as is more often the case, leave it up to the installer or homeowner to provide his or her own tools to perform the necessary installation and/or repair. It would therefore be desirable to provide a tool that could be used to perform more than one faucet installation and/or repair function.

SUMMARY OF THE INVENTION

In accordance with one aspect of the invention, a multi-function socket wrench is provided including an elongated body member having a nut receiving socket at one end for drivingly engaging a faucet mounting nut, and a pair of laterally spaced spanner-like projections protruding axially outwardly from one or the other end for drivingly engaging a cartridge valve retainer nut or the like.

In accordance with another aspect of the invention, these spanner-like projections are at the same end of the body member as the socket.

In accordance with another aspect of the invention, an aerator receiving recess is provided in the end of the body member opposite the socket.

In accordance with another aspect of the invention, one or more aerator receiving recesses are provided in the outer surface of the body member intermediate the ends thereof.

In accordance with another aspect of the invention, a pair of aerator receiving recesses are provided on opposite sides of the body member directly opposite each other.

In accordance with another aspect of the invention, four aerator receiving recesses are provided in the outer surface of the body member, two per side directly opposite each other.

In accordance with another aspect of the invention, a fluted and/or textured handle may be provided adjacent the end of the body member remote from the socket for improved grip and increased torque when grasped in one hand of the user.

These and other objects, advantages, features and aspects of the present invention will become apparent as the following description proceeds.

To the accomplishment of the foregoing and related ends, the invention, then, comprises the features hereinafter fully described and particularly pointed out in the claims, the following description and the annexed drawings setting forth in detail certain illustrative embodiments of the invention, these being indicative, however, of but several of the various ways in which the principles of the invention may be employed.

DETAILED DESCRIPTION OF THE PREFERRED EMBODIMENTS

Figure 1:
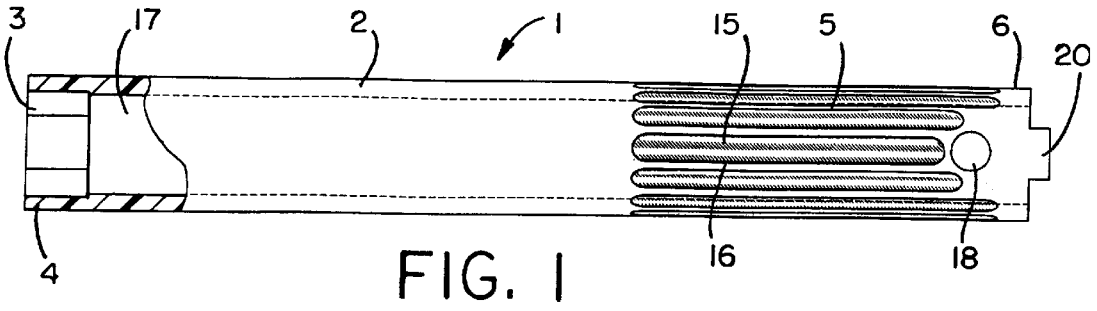
FIG. 1 is a side elevation view of one form of multi-function faucet wrench in accordance with this invention, partially broken away at one end to show a nut receiving socket therein.
Figure 2:
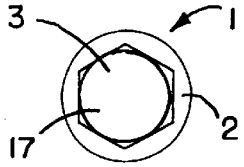
FIG. 2 is and end elevation view of the wrench of FIG. 1 as seen from the left end thereof.
Figure 3:
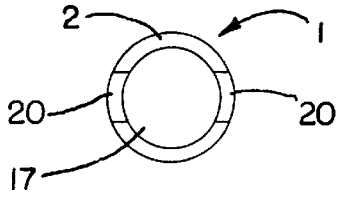
FIG. 3 is an end elevation view of the wrench of FIG. 1 as seen from the right end thereof.

Referring now in detail to the drawings, and initially to FIGS. 1 through 3, there is shown one form of multi-function faucet wrench 1 in accordance with the invention including an elongated hollow rod-like body member 2 having a nut receiving socket 3 at one end 4 for drivingly engaging a faucet mounting nut or the like. The socket 3 should of course be sized and shaped to receive the nut. For example if the nut is hex shaped, the socket should have a corresponding hex shape.

Figure 4:
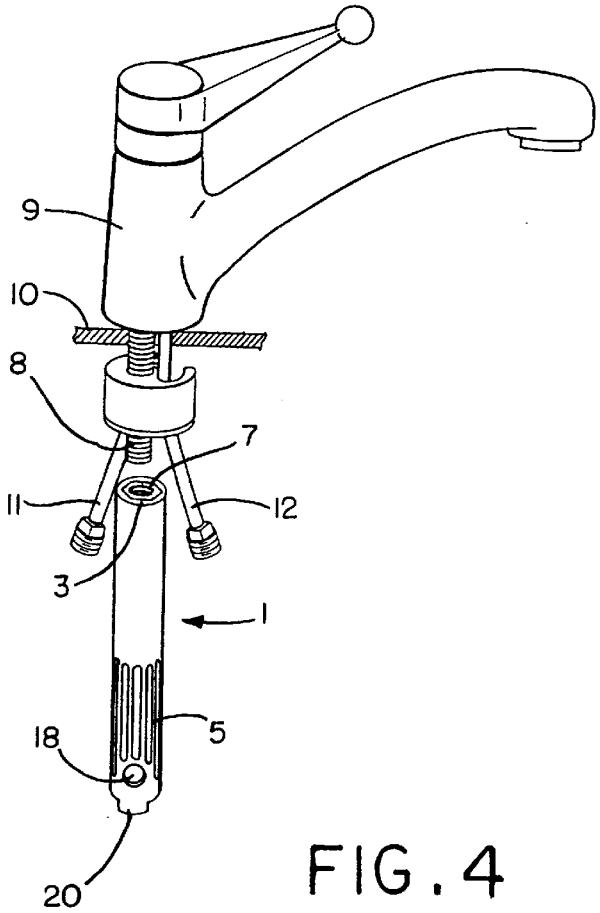
FIG. 4 is a schematic perspective view of the tool of FIG. 1 shown being used to install a faucet mounting nut onto a threaded mounting stud of a faucet body.

The wrench 1 should also be of a suitable length, for example, approximately 7¾ inches, to allow the user to grasp a handle portion 5 adjacent the end 6 of the wrench opposite the socket in one hand and rotate the wrench to thread a faucet mounting nut 7 or the like seated in the socket onto a threaded mounting stud 8 of a faucet body 9 to secure the faucet body to a sink or countertop 10 as schematically shown in FIG. 4. Also the outer diameter of the wrench 1 is desirably relatively small, for example, 1 inch or less depending on the size of the socket, in order to make it easier for the wrench to fit into tight spaces such as between the hot and cold water supply lines 11 and 12 of the faucet. However, it should be understood that the wrench could be of different lengths and/or diameters as desired. Also, the wrench could have a flat or differently shaped handle portion 5 as desired.

To improve the grip and provide increased torque, a plurality of circumferentially spaced longitudinally extending flutes 15 and/or texturing 16 may be provided on the handle portion 5 of the wrench 1 as schematically shown in FIG. 1. Also, the wrench 1 is desirably molded out of a suitable plastic having the requisite strength such as glass filled polycarbonate, and is desirably hollow throughout its entire length to reduce the amount of plastic required to make the wrench and to provide a longitudinal bore 17 in the wrench for receipt of the end of the threaded mounting stud 8 or the like during tightening or loosening of the mounting nut 7. Extending through opposite sides of the body member 2 adjacent the other end of the wrench is a crossbore 18 into which a cross-bar (not shown) may be inserted for use in applying additional torque to the wrench as needed.

Figure 5:
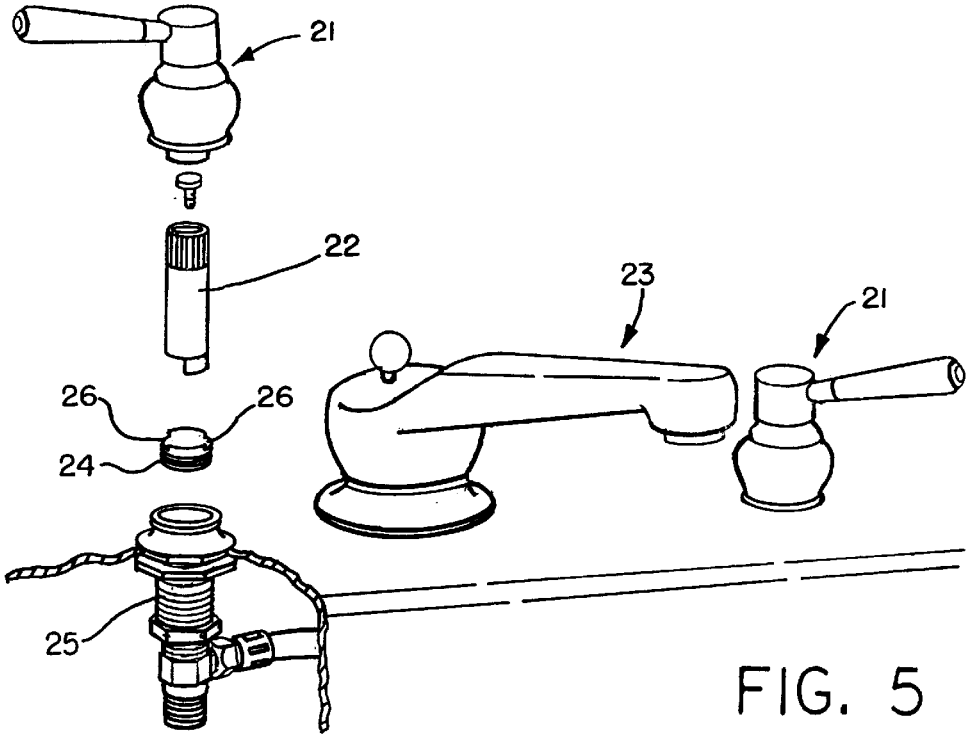
FIG. 5 is a partial exploded perspective view of one of the handles of a two handle faucet.
Figure 6:
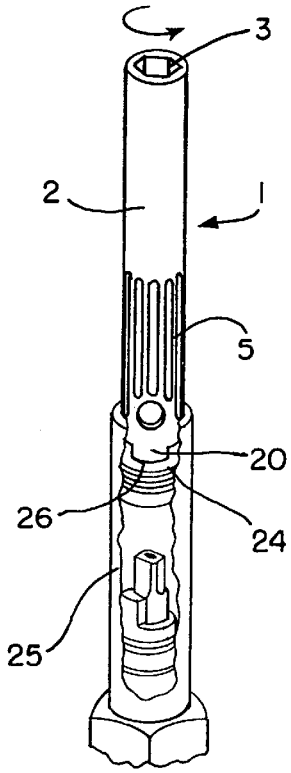
FIG. 6 is a perspective view of the valve body of FIG. 5 with portions broken away to show spanner-like projections on the end of the wrench of FIG. 1 opposite the nut receiving socket drivingly engaging a cartridge valve nut inside the valve body.

At the end 6 of the wrench 1 opposite the socket 3 are a pair of laterally spaced, axially outwardly extending spanner-like projections 20 that may be used to install and/or remove a cartridge valve retainer nut that retains a valve cartridge in a valve body of either a single handle or a two handle faucet or the like. An exploded view of one such handle 21 and associated stem extension 22 of a two handle faucet 23 is schematically shown in FIG. 5 with the cartridge valve retainer nut 24 unthreaded from the valve body 25. As can be seen in this figure and also in FIG. 6, the cartridge valve retainer nut 24 has a pair of laterally spaced apart slots 26 in one end that are adapted to be drivingly engaged by the spanner-like projections 20 on the wrench 1 for tightening and loosening the nut when the wrench is rotated in opposite directions.

Figure 7:
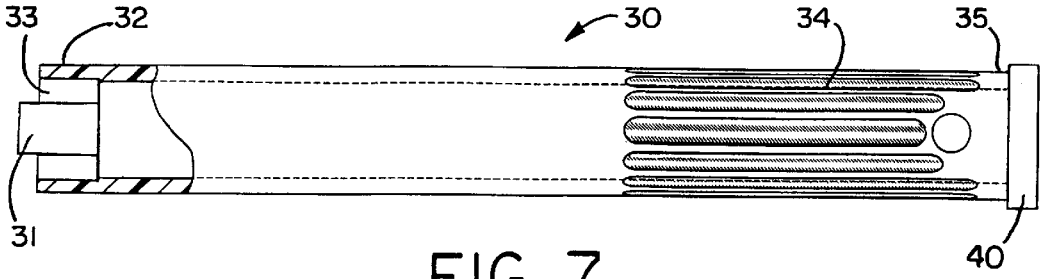
FIG. 7 is a side elevation view of another form of multi-function faucet wrench in accordance with this invention partially broken away at one end, such wrench having a nut receiving socket and spanner-like projections at such one end and an aerator receiving recess at the other end.
Figure 8:
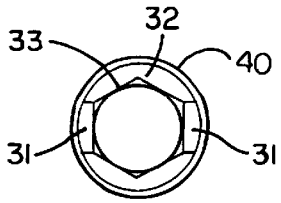
FIG. 8 is an end elevation view of the wrench of FIG. 7 as seen from the left end thereof.
Figure 9:
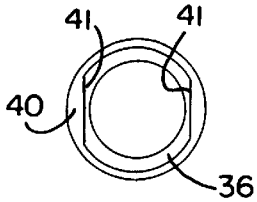
FIG. 9 is an end elevation view of the wrench of FIG. 7 as seen from the right end thereof.
Figure 10:
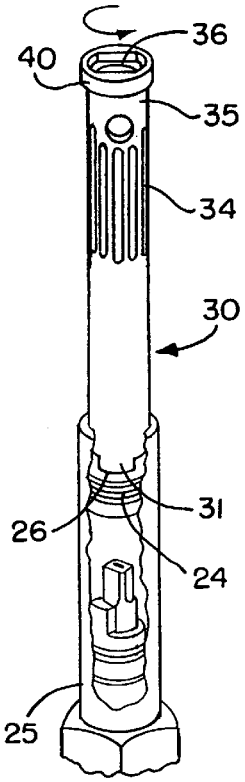
FIG. 10 is a perspective view of the valve body of FIG. 5 with portions broken away to show the spanner-like projections on the same end of the wrench of FIG. 7 as the nut receiving socket drivingly engaging a cartridge valve nut inside the valve body.

FIGS. 7 through 9 show another form of multi-function faucet wrench 30 in accordance with this invention which is similar to the wrench shown in FIGS. 1 through 3. However, in this embodiment, the spanner-like projections 31 protrude axially outwardly from the same end 32 of the wrench containing the nut receiving socket 33. This has the advantage that the handle portion 34 which is adjacent the end 35 of the tool opposite the socket is gripped the same way whether the tool 30 is used to drivingly engage a faucet mounting nut 7 in the manner previously described with reference to FIG. 4 or a cartridge valve retainer nut 24 as schematically shown in FIG. 10. However, in that event, the length of the projections 31 should be less than the thickness of the faucet mounting nut 7 so the projections do not interfere with the tightening of the faucet mounting nut.

Another advantage in providing the spanner-like projections 31 at the same end of the tool 30 as the socket 33 is that a faucet aerator receiving recess 36 or the like may be molded in the other end 35 of the tool for use in tightening and loosening a faucet aerator. Because of the size of the retainer ring of a standard faucet aerator, it may be necessary to provide an enlarged flange 40 at the other end 35 of the tool 30 in order to be able to mold an aerator receiving recess 36 of the required size in such other end.

Figure 15:
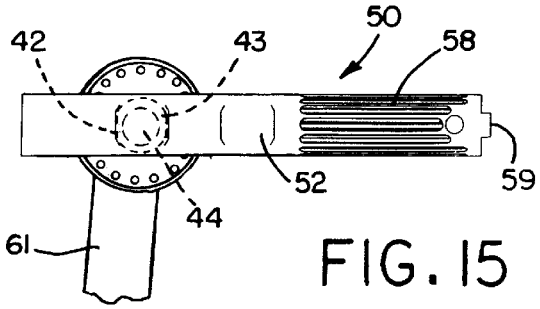
FIG. 15 is a fragmentary top plan view of the wrench and wand of FIG. 14.

As best seen in FIG. 9, the aerator receiving recess 36 is substantially cylindrical in shape except for a pair of laterally spaced part flats 41 on opposite sides for drivingly engaging corresponding flats 42 on the retaining ring 43 of the faucet aerator 44 (see FIG. 15).

Figure 11:
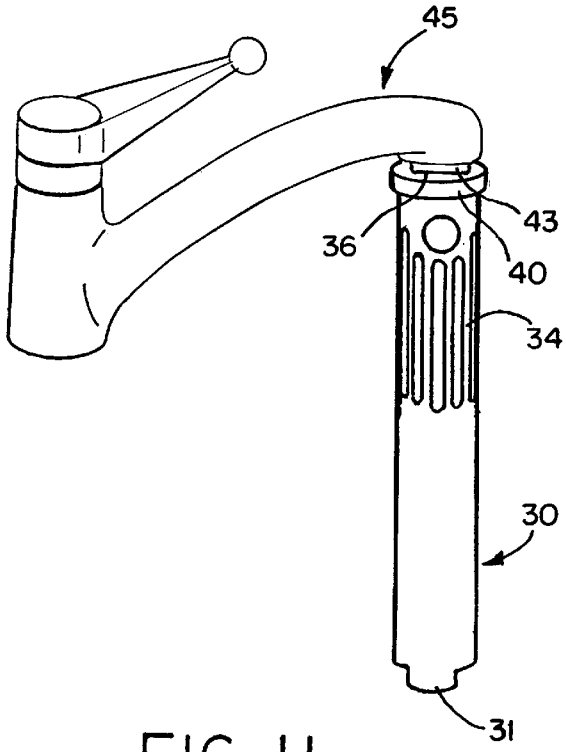
FIG. 11 is a perspective view showing an aerator receiving recess in the end of the wrench of FIG. 7 opposite the nut receiving socket engaging an aerator on a fixed spout styled faucet.

To either loosen or tighten the faucet aerator 44 using the tool 30 shown in FIGS. 7 through 9, the end 35 of the tool containing the aerator receiving recess 36 is aligned with the aerator retaining ring 43 on a faucet 45 and pressed into engagement therewith as schematically shown in FIG. 11. Then the tool is rotated in a clockwise or counterclockwise direction depending on whether the aerator is to be tightened or loosened.

Figure 12:
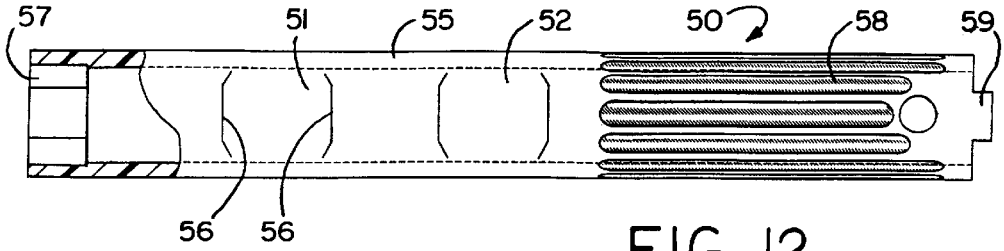
FIG. 12 is a top plan view of still another form of multi-function wrench in accordance with this invention having a plurality of aerator receiving recesses in the outer surface of the body member intermediate the ends thereof.
Figure 13:
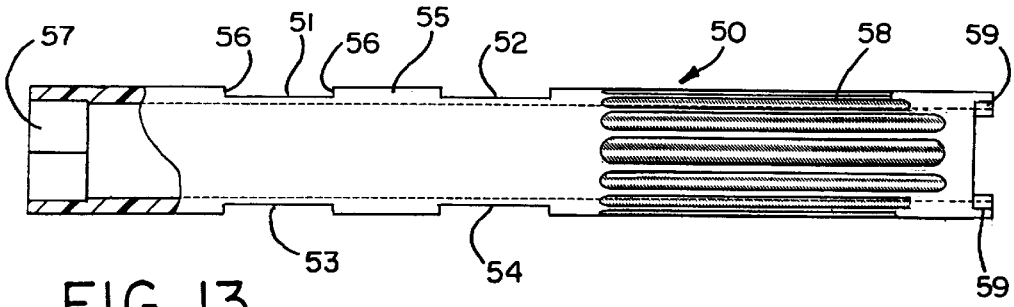
FIG. 13 is a side elevation view of the wrench of FIG. 12.

FIGS. 12 and 13 show yet another form of multi-function faucet wrench 50 in accordance with this invention which is substantially the same as the wrench 1 shown in FIGS. 1 through 3 except that four aerator receiving recesses 51 through 54 are provided in the outer surface of the body member 55 intermediate the length thereof, two on each side. Each recessed area 51 through 54 has a pair of axially spaced flats 56 for drivingly engaging corresponding flats 42 on the aerator retaining ring 43 in the manner previously described. Also, the aerator receiving recesses 51 and 52 on one side of the tool 50 are desirably in axially aligned space relation from each other intermediate the nut receiving socket 57 and handle portion 58 directly opposite the aerator receiving recesses 53 and 54 in the opposite side.

At the opposite end of the tool 50 from the socket 57 are two spanner-like projections 59. However, it will be appreciated that such projections 59 may be provided at the same end of the tool as the socket similar to that shown in FIGS. 7 through 9 if desired.

Figure 14:
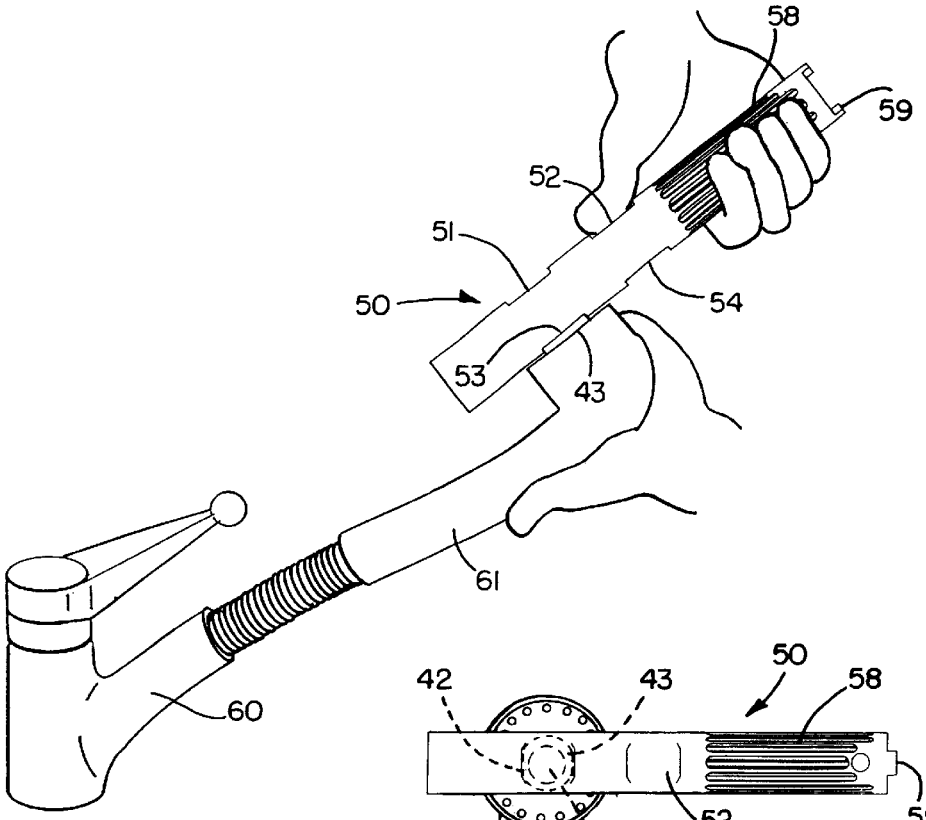
FIG. 14 is a side elevation view showing one of the aerator receiving recesses of the wrench of FIGS. 12 and 13 engaging an aerator on a pull-out wand of a faucet that has been rotated so the aerator is facing up.
Figure 16:
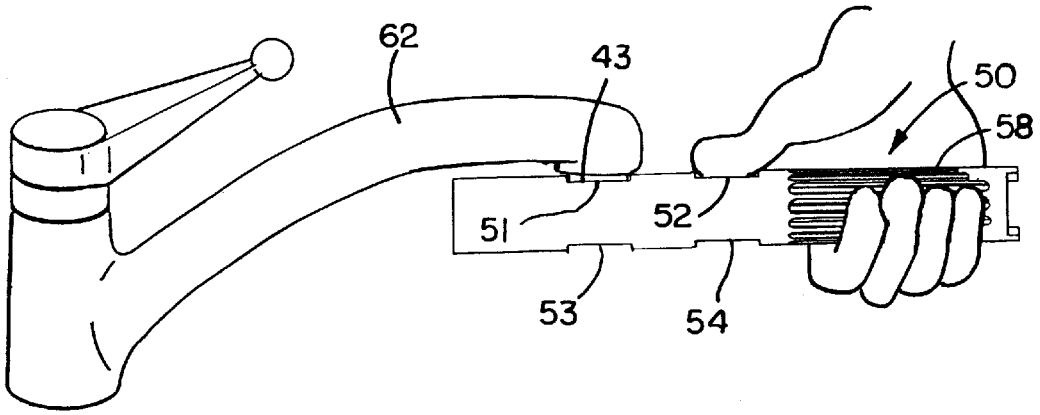
FIG. 16 is a side elevation showing another one of the aerator receiving recesses of the wrench of FIGS. 12 and 13 engaging an aerator on a fixed spout styled faucet.

Providing multiple aerator receiving recesses 51 through 54 in the tool has the advantage that if one of the recesses should become worn or distorted through use, another one of the recesses may be used to tighten or loosen a faucet aerator. Also, providing multiple recesses on each side of the tool ensures that one of the recesses can be used as a thumb rest whether the tool is used with a faucet 60 having a spray wand 61 that can be pulled out and rotated upside down so that the aerator retaining ring 43 can be accessed face up as shown in FIG. 14 or whether the tool is used to engage the aerator retaining ring from the underside of a fixed spout styled faucet 62 as schematically shown in FIG. 16. Placing the thumb on one of the aerator recesses 52, 54 on the same or opposite side of the aerator recess 51 or 53 that is engaged with the aerator retaining ring helps to stabilize the tool keeping it engaged with the aerator retaining ring while being rotated. In addition, having another aerator recess 51 directly opposite the aerator recess 53 being engaged with the aerator retaining ring allows the other aerator recess 51 to be used as a visual guide to help align the aerator recess 53 with respect to the aerator retaining ring as schematically shown in FIG. 14.

Although the invention has been shown and described with respect to certain preferred embodiments, it is obvious that equivalent alterations and modifications will occur to others skilled in the art upon the reading and understanding of the specification. The present invention includes all such equivalent alterations and modifications, and is limited only by the scope of the claims.

What is claimed is:

1. A multi-function faucet wrench comprising an elongated body member having opposite ends, a non-circular nut receiving socket at one end for drivingly engaging a faucet mounting nut, a single pair of laterally spaced projection means protruding axially outwardly from one or the other of said ends for drivingly engaging a cartridge valve retainer nut, said member being tubular throughout its length, and an aerator receiving recess in an outer surface of said member intermediate the length of said member, said recess having a bottom wall formed by a wall portion of said member and spaced apart flat sides facing one another for drivingly engaging corresponding flats on opposite sides of an aerator retaining ring for removing and installing an aerator on a faucet, said recess extending only part way into said tubular member.

2. The wrench of claim 1 further comprising another aerator receiving recess in the outer surface of said member directly opposite said aerator receiving recess.

3. The wrench of claim 1 further comprising a thumb rest in the outer surface of said member in spaced alignment with said aerator receiving recess.

4. The wrench of claim 3 further comprising another aerator receiving recess in the outer surface of said member directly opposite said aerator receiving recess and another thumb rest in the outer surface of said member in spaced alignment with said another aerator receiving recess.

5. The wrench of claim 4 wherein said thumb rests have the same shape as said aerator receiving recesses, whereby said thumb rests may also be used for the removal and installation of a faucet aerator.

6. A multi-function faucet wrench comprising an elongated body member having opposite ends, a non-circular nut receiving socket at one end for drivingly engaging a faucet mounting nut, a single pair of laterally spaced projection means protruding axially outwardly from an outermost end of said socket for drivingly engaging a cartridge valve retainer nut, and an aerator receiving recess in the other end of said member having spaced apart flat sides for drivingly engaging correspondingly spaced flats on opposite sides of an aerator retaining ring for removing and installing an aerator on a faucet.

7. The wrench of claim 1 wherein said projection means protrude axially outwardly from an outermost end of said socket.

8. The wrench of claim 7 wherein said projection means are straight throughout their length and width.

9. The wrench of claim 7 wherein said projection means have an axial length that is less than the thickness of the faucet mounting nut that is adapted to be received in said socket so that said projection means do not interfere with the partial receipt of the nut in said socket when the nut is against a surface that is engaged by said projection means.

10. The wrench of claim 1 wherein said projection means are at the other end of said member.

11. The wrench of claim 1 wherein said member is molded but of glass filled polycarbonate.

12. The wrench of claim 1 wherein said member has a hand grip adjacent the end opposite said socket for grasping in one hand of the user.

13. The wrench of claim 12 wherein an outer surface of said hand grip has circumferentially spaced longitudinally extending flutes to provide a better grip for increased torque when grasped by the user and rotated.

14. The wrench of claim 12 wherein an outer surface of said hand grip is textured to provide a better grip for increased torque when grasped by the user and rotated.

15. A multi-function faucet wrench comprising an elongated tubular body member having a tubular wall, a non-circular nut receiving socket at one end of said member for drivingly engaging a faucet mounting nut, and an aerator receiving recess in an outer surface of said tubular wall intermediate the length of said member, said recess having a bottom wall formed by a portion of said tubular wall and spaced apart flat sides facing one another for drivingly engaging corresponding flats on opposite sides of an aerator retaining ring for removing and installing an aerator on a faucet, said recess extending only part way into said tubular wall.

16. The wrench of claim 15 wherein there are two aerator receiving recesses in the outer surface of said member directly opposite each other intermediate the length of said member.

17. The wrench of claim 15 wherein there are two pairs of aerator receiving recesses in the outer surfaces of said member intermediate the length of said member, the recesses of each pair being directly opposite each other and in spaced alignment with the recesses of the other pair.

18. The wrench of claim 15 wherein said recess extends transversely of said member.

19. The wrench of claim 15 wherein said recess extends transversely across the entire outer surface of said member.

* * * * *